US009266217B2

(12) United States Patent
Esenwein

(10) Patent No.: US 9,266,217 B2
(45) Date of Patent: Feb. 23, 2016

(54) HAND-HELD POWER TOOL HAVING ELASTOMER ELEMENTS FOR SUPPORTING COMPONENTS IN THE HOUSING

(75) Inventor: Florian Esenwein, Uhingen-Holzhausen (DE)

(73) Assignee: Robert Bosch GmbH, Stuttgart (DE)

( * ) Notice: Subject to any disclaimer, the term of this patent is extended or adjusted under 35 U.S.C. 154(b) by 702 days.

(21) Appl. No.: 13/578,221

(22) PCT Filed: Dec. 13, 2010

(86) PCT No.: PCT/EP2010/069460

§ 371 (c)(1), (2), (4) Date: Aug. 9, 2012

(87) PCT Pub. No.: WO2011/098172

PCT Pub. Date: Aug. 18, 2011

(65) Prior Publication Data

US 2012/0305278 A1 Dec. 6, 2012

(30) Foreign Application Priority Data

Feb. 11, 2010 (DE) ..... 10 2010 001 793

(51) Int. Cl.

| | |
|---|---|
| ***B25F 5/02*** | (2006.01) |
| ***B25F 5/00*** | (2006.01) |
| ***B24B 41/00*** | (2006.01) |
| ***B24B 23/02*** | (2006.01) |

(52) U.S. Cl.

CPC ..... *B24B 41/007* (2013.01); *B24B 23/028* (2013.01); *B25F 5/006* (2013.01)

(58) Field of Classification Search

CPC ..... B25F 5/02; B25F 5/00; B25F 5/006

USPC ..... 173/162.2, 217, 170–171; 116/460–431

See application file for complete search history.

(56) References Cited

U.S. PATENT DOCUMENTS

| | | | | |
|---|---|---|---|---|
| 4,837,892 | A * | 6/1989 | Lo | 16/431 |
| 6,729,414 | B2 * | 5/2004 | Cooper et al. | 173/217 |
| 2002/0096341 | A1 | 7/2002 | Hagan et al. | |

FOREIGN PATENT DOCUMENTS

| | | | |
|---|---|---|---|
| CN | 1575218 | A | 2/2005 |
| CN | 1891413 | A | 1/2007 |
| CN | 101066589 | A | 11/2007 |
| DE | 10 2006 020 172 | A1 | 11/2007 |
| DE | 10 2008 063 113 | A1 | 7/2009 |
| EP | 1 741 520 | A2 | 1/2007 |
| JP | 2004-249421 | A | 9/2004 |
| RU | 2252348 | C1 | 5/2005 |

OTHER PUBLICATIONS

International Search Report corresponding to PCT Application No. PCT/EP2010/069460, mailed Apr. 27, 2011 (German and English language document) (8 pages).

* cited by examiner

*Primary Examiner* — Michelle Lopez

(74) *Attorney, Agent, or Firm* — Maginot, Moore & Beck LLP

(57) ABSTRACT

A hand-held power tool is provided which includes a drive unit in a housing, a switch device, and elastomer elements. The drive unit is configured to be switched on and off with the switch device which comprises a switch accommodated inside the housing. The elastomer elements are molded onto the outside of the housing and onto the inside of the housing and are connected to each other via an opening in a wall of the housing. An elastomer element on the inside of the housing forms an elastomer bearing configured to support the switch.

10 Claims, 4 Drawing Sheets

HAND-HELD POWER TOOL HAVING ELASTOMER ELEMENTS FOR SUPPORTING COMPONENTS IN THE HOUSING

This application is a 35 U.S.C. §371 National Stage Application of PCT/EP2010/069460, filed on Dec. 13, 2010, which claims the benefit of priority to Serial No. DE 10 2010 001 793.0, filed on Feb. 11, 2010 in Germany, the disclosures of which are incorporated herein by reference in their entirety.

The disclosure relates to a portable power tool having a drive device in a housing.

BACKGROUND

DE 10 2006 020 172 A1 describes a cordless screwdriver or cordless drill which has an electric drive motor in a housing, wherein the motor housing, in which the drive motor is arranged, is adjoined by a transmission housing having a transmission, via which the motor movement is transmitted to a tool. In the joining region between the motor housing and the transmission housing there is arranged a sealing element which consists of two half-rings made of thermoplastic elastomer which is molded, next to the joining region, onto the end side of the motor housing. The half-rings also have the function of damping the transmission and sealing off the transmission space from the motor space.

Located on a handle of the housing there is a switch-on element which is connected to a switch which is arranged in the housing and via which the electric drive motor is intended to be switched on and off. Such switches inside the housing are held in their position for example via elastically deformable latching lugs. In order to be able to join the housing parts together, it is necessary to provide the switch mount in the housing with play, which must not exceed a particular degree, however, since otherwise vibrations of the power tool can lead to damage to the switch or to the connection between the switch and the motor.

SUMMARY

The disclosure is based on the object of increasing the operational reliability of portable power tools through simple measures.

This object is achieved according to the disclosure through the features described in detail below.

The portable power tool according to the disclosure has a drive device, usually an electric drive motor, downstream of which there is connected a transmission, via which the drive movement of the motor is transmitted to a tool. The portable power tool is for example an angle grinder, a cordless screwdriver or the like. A switch device having a switch, which is arranged inside the housing and is connected to the drive motor of the drive device, is used to switch the drive device on and off. When the drive motor is an electric motor, the mechanical switching movement initiated by the operator is converted via the switch into an electric switching movement that closes the circuit when the motor is switched on and opens the circuit when the motor is switched off. The switch is either connected to the drive motor via electric connecting cables or is flange-mounted directly onto the motor.

In the portable power tool according to the disclosure, elastomer elements which are connected together via an opening in the housing wall are respectively molded on the outside and on the inside of the housing. This allows the production of the elastomer elements on the inside and outside in a single work step, in which the elastomer material is molded onto the housing from one side and can pass through the opening in the housing wall to the opposite side. In this case, the elastomer material can be molded onto the housing wall both from the inside and from the outside.

It is furthermore provided that the elastomer element located on the inside of the housing forms an elastomer bearing configured to support the switch. Supporting the switch inside the housing on the soft material provides effective oscillation damping of the switch, and, at the same time, allows installation play for the switch, thereby making it easier to join the housing parts together in a flush manner. The play is at least partially compensated by the soft component of the elastomer bearing, and so, in the fully fitted and assembled state, the switch is accommodated in the housing without the possibility of relative movement. At the same time, oscillations and vibrations which proceed from the drive motor or arise during workpiece machining are effectively damped or reduced, and so the risk of the switch being damaged or the connection between the switch and the drive motor or between the switch and the electric power supply being released is significantly decreased.

In addition or alternatively to increased play in the mounting of the switch inside the housing, it is also possible to allow an increased tolerance in the dimensions of the switch, since this is likewise compensated by the flexibility of the soft component in the elastomer element.

Consideration is given in particular to a thermoplastic elastomer (TPE) as the material for the elastomer element. However, embodiments made of EPDM, PU, PVC or the like are also possible.

The elastomer element on the outside of the housing, with which the elastomer bearing on the inside is configured in one piece, preferably forms a handle element, via which the operator can grasp and guide the portable power tool. Due to its flexibility and the increased friction, the elastomer element affords high operating comfort, and in addition the portable power tool can be held and guided safely.

In order to provide a better connection between the housing and the elastomer on the inside and outside, elevations and/or depressions on the walls of the housing, which are encapsulated by the elastomer material, can be provided. Such elevations and depressions, for example channels, improve the adhesion of the elastomer material to the housing.

The opening in the housing wall, via which the elastomer elements on the inside and the outside are connected together in one piece, is expediently filled completely with the elastomer material. A cross section of the opening can be round or nonround, for example oval or longitudinally directed in the form of a channel of limited length. The opening cross section is expediently matched to the flow behavior of the elastomer material, which is liquid during the injection-molding process. When the opening in the housing wall is a channel, the latter extends for example in the longitudinal direction of the housing. However, an orientation in the circumferential direction is also possible.

The elastomer bearing is preferably embodied as a longitudinally directed support rib which extends on the inside of the housing. The support rib can be formed in a straight line and extend in the longitudinal direction of the housing. According to a further expedient embodiment, it is provided that the housing is embodied in multiple parts, in particular in two parts with two housing half shells, wherein an elastomer element is arranged on the inside and outside of each housing half shell. The elastomer elements on the inside of the housing form interacting elastomer bearings for the switch and are configured in a mirror-symmetrical manner with respect to one another in the assembled state of the housing half shells.

If the elastomer bearings are formed as elongate support ribs, these are aligned in particular parallel to one another.

The housing, in which the switch is arranged, forms in particular a motor housing for accommodating the drive motor, wherein the motor housing is adjoined by a transmission housing having a transmission, via which the motor movement is converted into a movement of the tool of the portable power tool.

In another embodiment, in addition to the elastomer elements on the inside or outside of the housing, further elastomer elements are molded on the housing, said further elastomer elements having further functions. For example, a further elastomer element forms a bearing for a component of the drive device, in particular a bearing for the electric drive motor of the portable power tool. This elastomer bearing can, just like the elastomer bearing according to the disclosure for supporting the switch, be formed in one piece with a further elastomer element molded on the outside of the housing. This further elastomer element also improves gripping and handling of the portable power tool and/or has a sealing function in the transition region between the motor housing and the transmission housing. In the last-mentioned case, the elastomer element is located on the end side of a housing part, either on the motor housing and/or on the transmission housing, and extends at least partially over the end side of this housing.

BRIEF DESCRIPTION OF THE DRAWINGS

Further advantages and expedient embodiments are described in detail below with reference to the figures and the drawings, in which.

DETAILED DESCRIPTION

Figure 1:
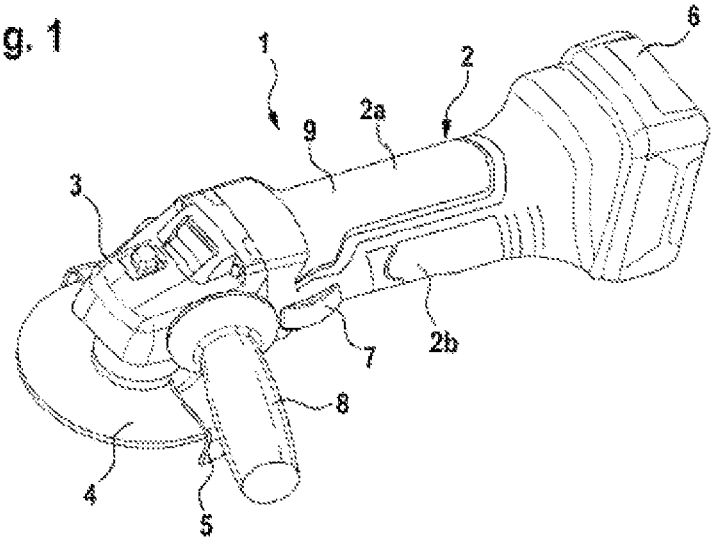
FIG. 1 shows a perspective illustration of a portable power tool configured as a cordless angle grinder.

In the figures, identical components are provided with identical reference signs.

As shown in the figures, the portable power tool 1 is configured as an angle grinder and has, as a drive device, an electric drive motor in a motor housing 2 and a transmission in a transmission housing 3 which is formed separately therefrom and adjoins the motor housing. The drive movement of the motor is converted into a tool movement of the tool 4 via the drive device having the electric drive motor and the transmission. In an exemplary embodiment, the tool 4 forms a grinding disk, which is overlapped by a protective hood 5. A battery pack 6 adjoins the rear part of the motor housing 2 and supplies electric power. A switch element 7 configured to switch the electric drive motor on and off is located in the front part of the motor housing 2, next to the transmission housing 3. The switch element 7 projects beyond the outside of the motor housing 2 and can be actuated by the operator in an ergonomically favorable manner. The switch element 7 is connected to a switch which is located inside the motor housing 2 and via which the electric power supply to the drive motor is switched on and off. The motor housing 2 is constructed in two parts and comprises two assembled housing shells 2*a* and 2*b*. Located on the top side of the housing 2 is an elastomer element 9 which is injection-molded as a coating onto the outside of the motor housing 2.

An auxiliary handle 8 is arranged on the side of the transmission housing 3 and extends transversely to the longitudinal axis of the portable power tool.

The switch 10, which is arranged inside the motor housing and via which the electric drive motor is switched on and off, is shown in FIGS. 2, 3, 4, 5, and 6. The switch 10 is electrically connected to the drive motor and can be switched on and off via the switch element 7 (shown in FIG. 1).

Figure 2:
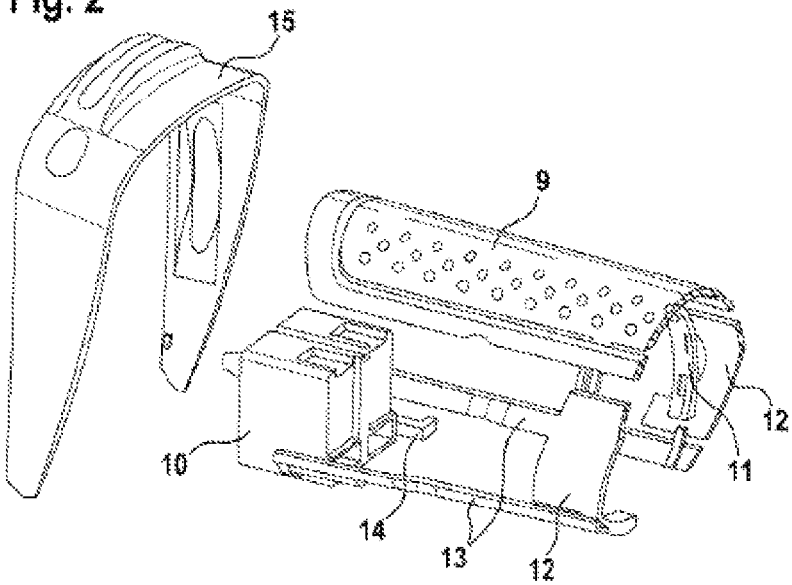
FIG. 2 shows an exploded illustration of elastomer elements which are molded onto the outside and inside of the housing in the injection-molding process.
Figure 3:
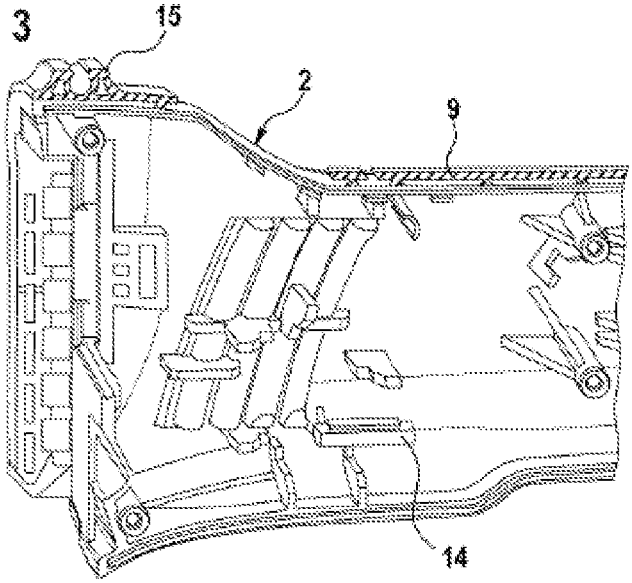
FIG. 3 shows a view of the inside of a half shell of the motor housing with a molded elastomer support rib which forms an elastomer bearing for supporting a switch for the electric drive motor.

FIG. 2 also illustrates the elastomer element 9 which is injection-molded onto the outside of the motor housing. The elastomer element is formed in one piece with further elastomer elements 11, 12, 13, and 14, some of which extend on the outside of the housing and some on the inside of the housing, wherein elastomer elements located on opposite housing sides are connected together via openings in the housing wall of the motor housing. The elastomer element 14 forms an elastomer bearing configured to support the switch 10. In a preferred embodiment, each half shell of the motor housing includes one or more elastomer elements on the outside of the housing and on the inside of the housing. Each housing half shell has at least one elastomer element on the outside and an elastomer bearing configured to support the switch 10.

A further, clip-like elastomer element 15 is arranged in the rear region of the housing and is located axially outwardly relative to the switch 10. The clip-like elastomer element 15 is molded onto the outside of the motor housing in the region of the end side of the motor housing and is located in the transition between the motor housing and the battery. The elastomer element 15 is configured to seal and reduce oscillations between the motor housing and the battery.

Figure 4:
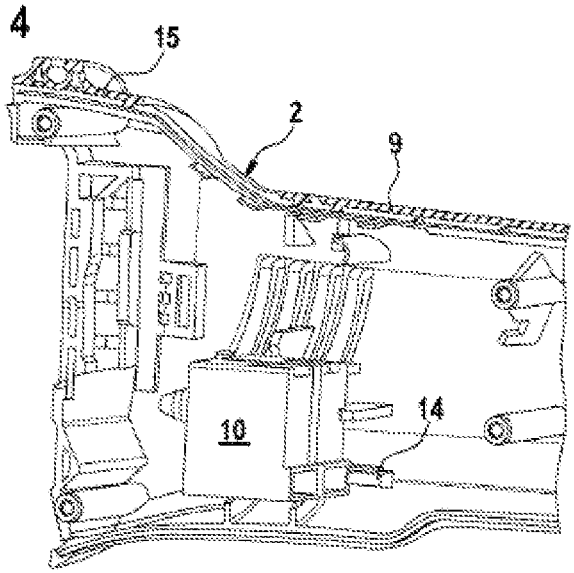
FIG. 4 shows a similar illustration to FIG. 3, but additionally with a switch inserted.

The elastomer bearing 14 is configured as a rib which extends in the longitudinal direction and, as shown in FIGS. 2 and 4, extends beyond the switch 10 in the longitudinal direction. The elastomer bearing 14 has preferably a greater axial length than the switch 10, such that a plug module can be received by the elastomer bearing 14 in addition to the switch 10. The plug module provides the electrical connection between the switch 10 and the drive motor or between the switch 10 and the power supply.

Figure 5:
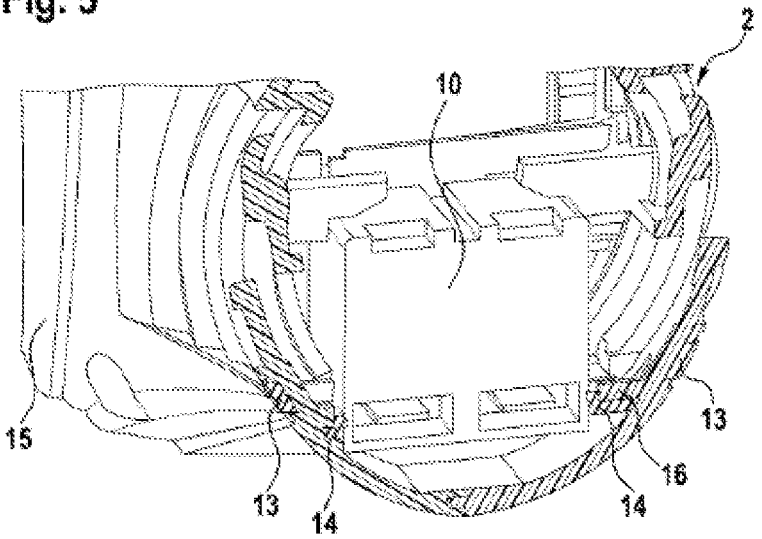
FIG. 5 shows a further view of the switch accommodated in the motor housing.
Figure 6:
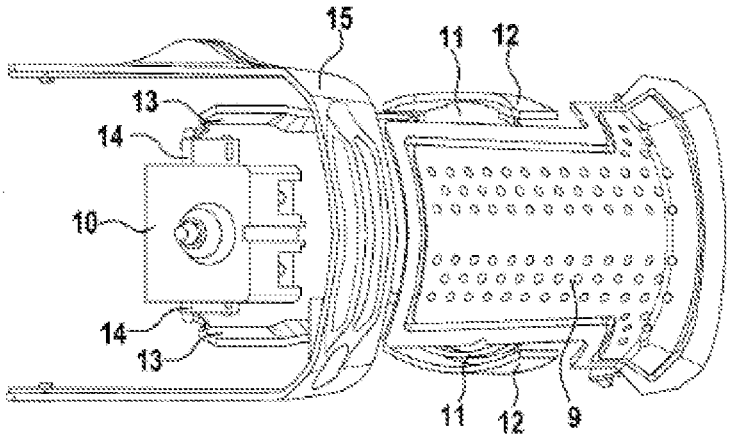
FIG. 6 shows a detail illustration of the elastomer elements including the switch.
Figure 7:
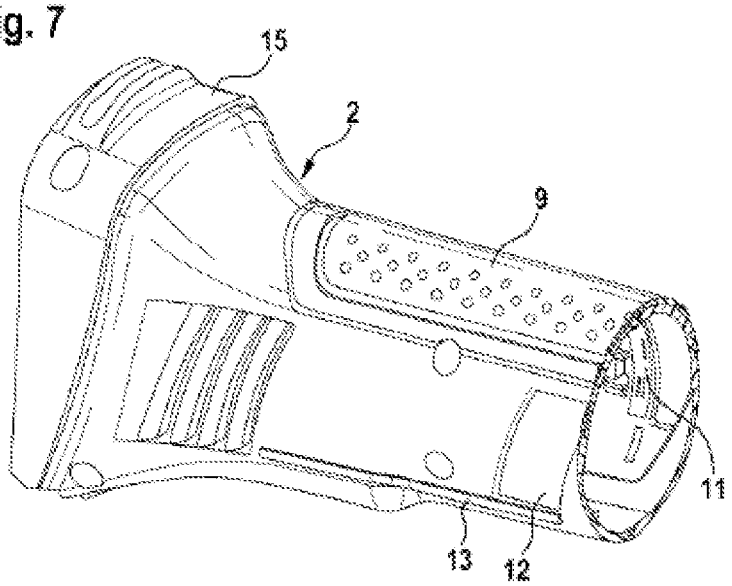
FIG. 7 shows the motor housing having the elastomer elements illustrated in FIG. 2.

As shown in the sectional illustration of FIG. 5, an inwardly extending protrusion 16 is formed in one piece with the wall of the housing 2 on the inside of the housing. The extending protrusion 16 is configured to receive and support the elastomer bearing 14. The elastomer bearing 14 directs the forces that arise in operation and originate from the switch 10 or the oscillations of the portable power tool to the protrusion 16.

Figure 8:
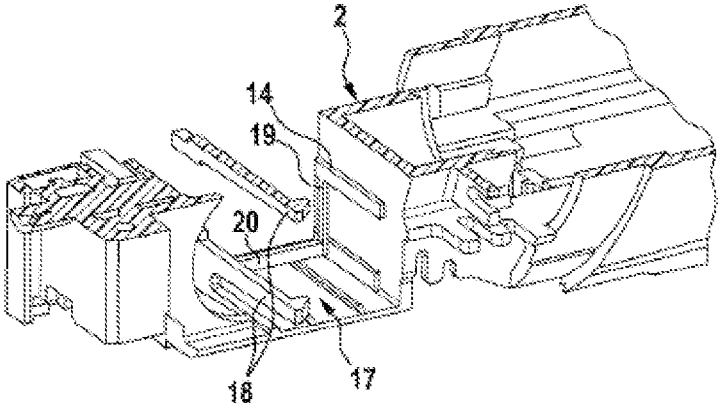
FIG. 8 shows a view of the bearing mount on the inside of the housing including the elastomer bearing.

FIG. 8 illustrates the mount 17 in the housing 2 for the switch. Elastically held latching members 18, which laterally bound the mount 17 and secure the inserted switch in the mount 17 with a latching fit, are configured in one piece with the housing 2.

As shown in FIG. 8, a first and a second elastomer rib 19 and 20, respectively, are arranged at right angles relative to one another, extend along the side walls of the mount 17, and are formed in one piece with the elastomer bearing 14. Abutments on the housing are softly cushioned in the mount 17 via the various sections of the elastomer bearing 14 and/or of the elastomer ribs 19 and 20, to softly support the inserted switch in a corresponding manner.

A further elastomer element is arranged on the inside of the housing and is formed in one piece with an elastomer element on the outside of the housing. The further elastomer element forms a bearing for a component of the drive device, in particular a bearing for the drive motor. In some embodiments, both the elastomer bearing for the switch and the elastomer bearing for the drive motor are configured in one piece with the same elastomer element on the outside of the housing.

The invention claimed is:

1. A portable power tool comprising:

a housing having a housing wall, with an outside and an inside, and an opening formed in the housing wall between the outside and the inside;

a drive device located in the housing;

a switch device having a switch, said switch device configured to switch on and off the drive device, the switch arranged inside the housing; and a plurality of elastomer elements molded on the outside and on the inside of the housing and connected together through the opening in the housing wall, wherein at least one of the plurality of elastomer elements is located on the inside of the housing and forms an elastomer bearing configured to support the switch, wherein the opening in the housing wall is a channel having a longitudinal length and a transverse length, and the longitudinal length is greater than the transverse length.

2. The portable power tool of claim 1, wherein at least one of the plurality of elastomer elements is located on the outside of the housing and forms a handle element.

3. The portable power tool of claim 1, wherein the elastomer bearing is a longitudinally oriented support rib.

4. The portable power tool of claim 1, wherein the elastomer bearing projects beyond at least one side wall of the switch.

5. The portable power tool of claim 1, wherein:

the housing comprises two housing half shells each having an inside and an outside; and the plurality of elastomer elements are located on the inside and outside of each housing half shell.

6. The portable power tool of claim 5, wherein the elastomer bearing is one of a plurality of elastomer bearings arranged in a mirror-symmetrical manner with respect to one another on the inside of the housing half shells.

7. The portable power tool of claim 1, wherein the elastomer bearing is arranged on the housing and is configured to accommodate a plug module.

8. The portable power tool of claim 1 further comprising:

a separately formed damping element arranged on the inside of the housing and configured to support the switch.

9. The portable power tool of claim 1 further comprising:

a further elastomer element arranged on the inside of the housing and formed in one piece with at least one of the plurality of elastomer elements on the outside of the housing, wherein the further elastomer element forms a bearing for a component of the drive device.

10. A portable power tool comprising:

a housing having a housing wall, with an outside and an inside, and an opening formed in the housing wall between the outside and the inside;

a drive device located in the housing;

a switch device having a switch, said switch device configured to switch on and off the drive device, the switch arranged inside the housing;

a plurality of elastomer elements molded on the outside and on the inside of the housing and connected together through the opening in the housing wall, wherein at least one of the plurality of elastomer elements is located on the inside of the housing and forms an elastomer bearing configured to support the switch; and a further elastomer element arranged on the inside of the housing and formed in one piece with at least one of the plurality of elastomer elements on the outside of the housing, wherein the further elastomer element forms a bearing for a component of the drive device.

* * * * *